US011435167B2

(12) United States Patent
Wilson

(10) Patent No.: US 11,435,167 B2
(45) Date of Patent: Sep. 6, 2022

(54) SILK BLEND BALLISTIC FABRIC

(71) Applicant: Jeffrey Wilson, Santa Ana, CA (US)

(72) Inventor: Jeffrey Wilson, Santa Ana, CA (US)

( * ) Notice: Subject to any disclaimer, the term of this patent is extended or adjusted under 35 U.S.C. 154(b) by 107 days.

(21) Appl. No.: 15/930,529

(22) Filed: May 13, 2020

(65) Prior Publication Data

US 2021/0356235 A1 Nov. 18, 2021

(51) Int. Cl.

| | |
|---|---|
| ***F41H 1/02*** | (2006.01) |
| ***D03D 1/00*** | (2006.01) |
| ***D02G 3/44*** | (2006.01) |
| ***D03D 15/283*** | (2021.01) |
| ***D03D 15/233*** | (2021.01) |

(52) U.S. Cl.

CPC ..... *F41H 1/02* (2013.01); *D02G 3/443* (2013.01); *D03D 1/0052* (2013.01); *D03D 15/233* (2021.01); *D03D 15/283* (2021.01); *D10B 2211/04* (2013.01); *D10B 2331/021* (2013.01); *D10B 2401/063* (2013.01); *D10B 2501/04* (2013.01)

(58) Field of Classification Search

None

See application file for complete search history.

(56) References Cited

U.S. PATENT DOCUMENTS

| | | | | |
|---|---|---|---|---|
| 5,090,053 | A | 2/1992 | Hayes | |
| 5,456,974 | A | 10/1995 | Lundblad | |
| 7,820,565 | B2 | 10/2010 | Van Heerden | |
| 10,101,128 | B2 | 10/2018 | Cushingham | |
| 2007/0010151 | A1 | 11/2007 | Cunningham | |
| 2014/0245516 | A1* | 9/2014 | Cushingham | F41H 5/02 2/2.5 |
| 2015/0071978 | A1 | 3/2015 | Chang | |
| 2017/0340039 | A1 | 11/2017 | Jur | |
| 2018/0105959 | A1 | 4/2018 | Shahkarami | |

FOREIGN PATENT DOCUMENTS

| | | |
|---|---|---|
| WO | WO2014143346 | 9/2014 |

* cited by examiner

*Primary Examiner* — Arti Singh-Pandey

(57) ABSTRACT

A silk blend ballistic fabric for creating comfortable and flexible bulletproof apparel includes a plurality of silk threads and a plurality of para-aramid fiber threads interwoven with the plurality of silk threads to create a fabric. An alternative embodiment of the disclosure generally comprises a hybrid thread comprising a silk thread and a para-aramid fiber thread twisted with the silk thread. The resulting hybrid thread can be woven to create the fabric. The resulting fabric is bulletproof and substantially flexible to create articles of clothing such as, but not limited to, trousers, shirts, and the like.

6 Claims, 3 Drawing Sheets

SILK BLEND BALLISTIC FABRIC

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ballistic fabrics and more particularly pertains to a new ballistic fabric for creating comfortable and flexible bulletproof apparel.

(2) Description of Related Art Including Information Disclosed Under 37 CFR 1.97 and 1.98

The prior art relates to ballistic fabrics and particularly to blended materials. Many existing ballistic fabrics are stiff and uncomfortable for the wearer, and do not incorporate soft, yet strong, materials such as silk.

BRIEF SUMMARY OF THE INVENTION

An embodiment of the disclosure meets the needs presented above by generally comprising a plurality of silk threads and a plurality of para-aramid fiber threads interwoven with the plurality of silk threads to create the fabric.

An alternative embodiment of the disclosure generally comprises a hybrid thread comprising a silk thread and a para-aramid fiber thread twisted with the silk thread. The resulting hybrid thread can be woven to create the fabric. The resulting fabric is bulletproof and substantially flexible to create articles of clothing such as, but not limited to, trousers, shirts, and the like.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
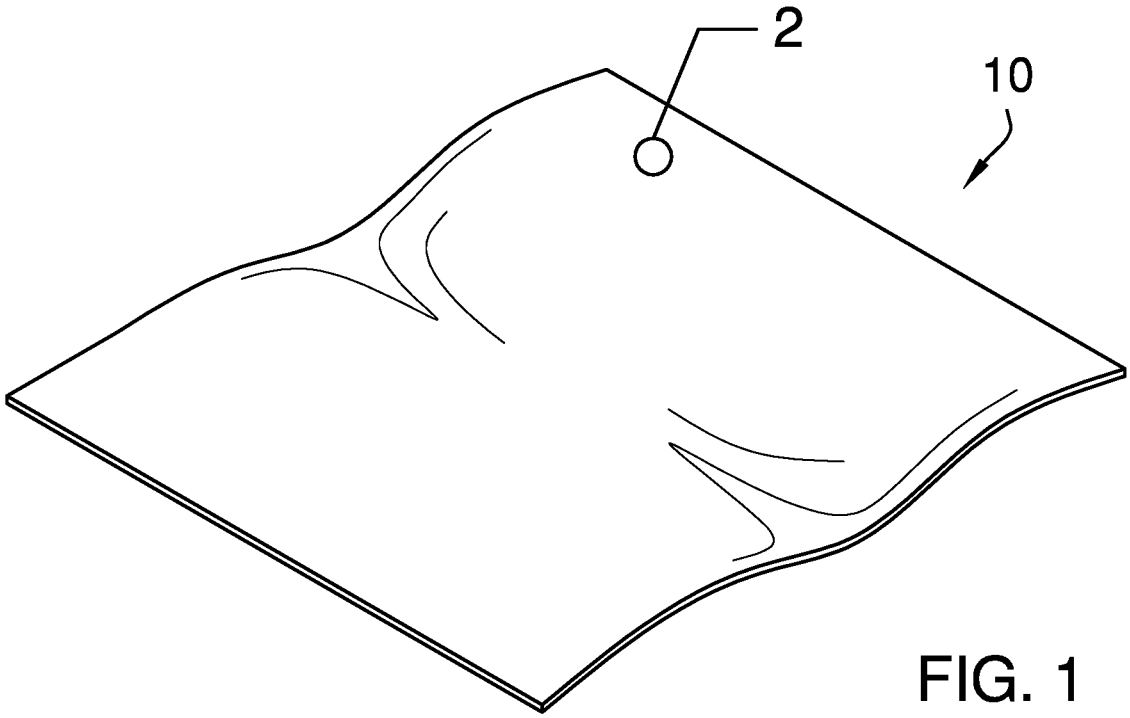
FIG. 1 is an isometric view of a silk blend ballistic fabric according to an embodiment of the disclosure.
Figure 2:
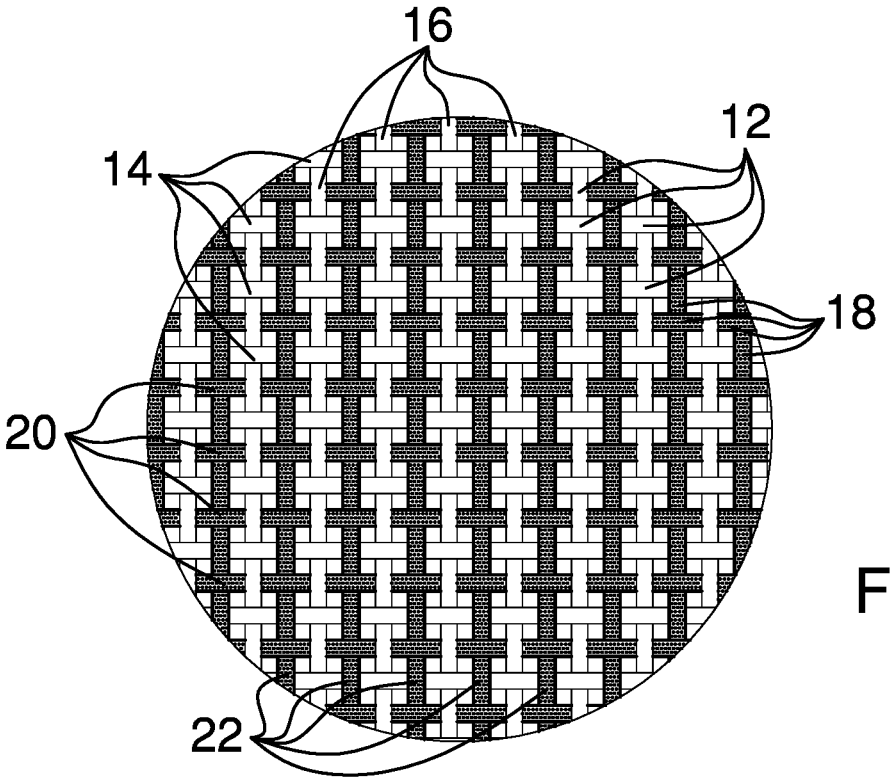
FIG. 2 is a detail view of an embodiment of the disclosure.
Figure 3:
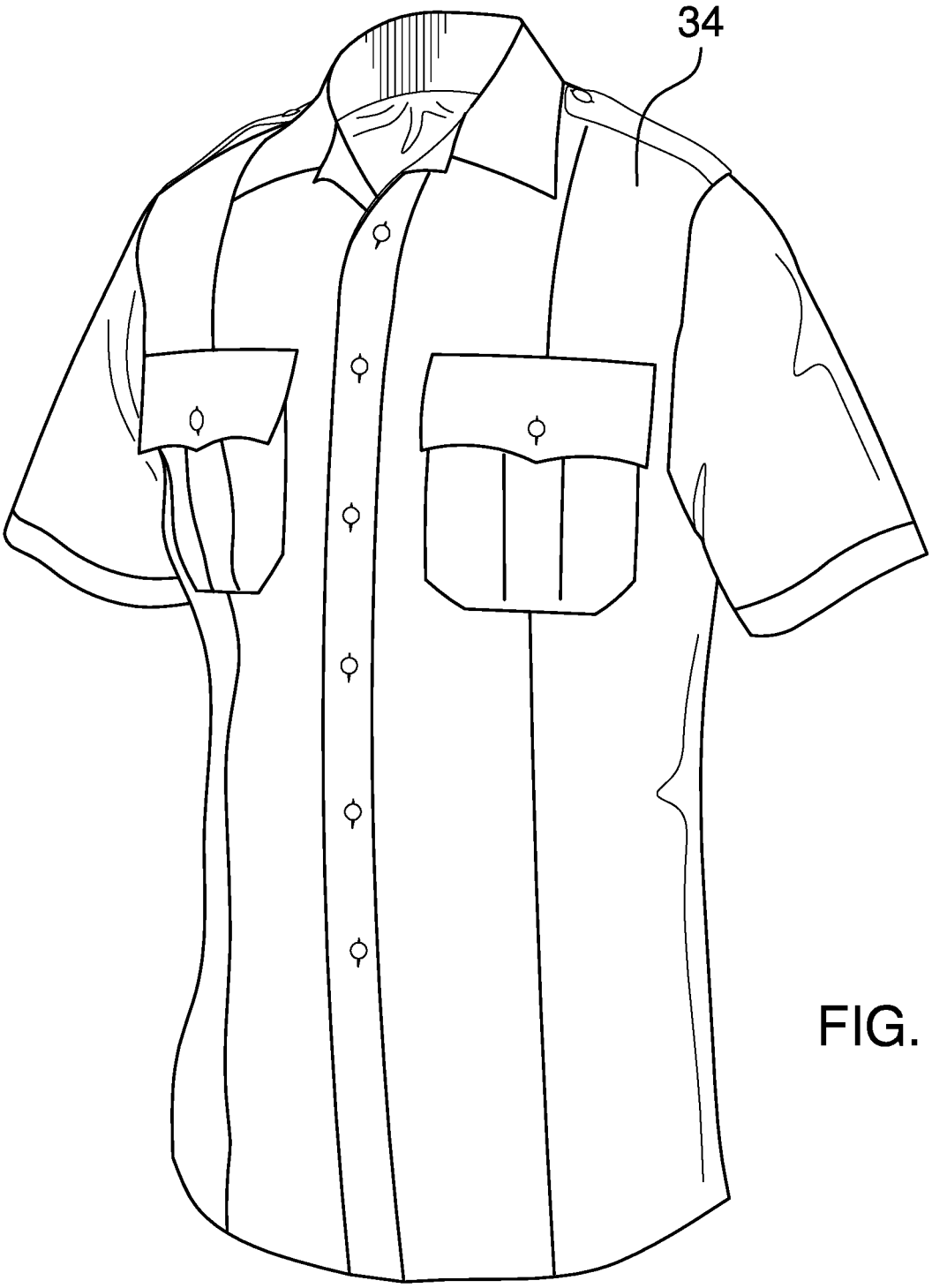
FIG. 3 is an in-use view of an embodiment of the disclosure.

With reference now to the drawings, and in particular to FIGS. 1 through 4 thereof, a new ballistic fabric embodying the principles and concepts of an embodiment of the disclosure and generally designated by the reference numeral 10 will be described.

As best illustrated in FIGS. 1 through 4, the silk blend ballistic fabric 10 generally comprises a plurality of silk threads 12. The plurality of silk threads 12 may comprise a plurality of horizontal silk threads 14 interwoven through a plurality of vertical silk threads 16.

A plurality of para-aramid fiber threads 18 is interwoven with the plurality of silk threads 12. The plurality of para-aramid fiber threads 18 may comprise a plurality of horizontal para-aramid fiber threads 20 interwoven through a plurality of vertical para-aramid fiber threads 22 and the plurality of vertical silk threads 16. The plurality of vertical para-aramid fibers 22 is also interwoven through the plurality of horizontal silk threads 12.

The plurality of para-aramid fiber threads 18 and the plurality of silk threads 12 may be present in a 1:1 ratio. The thickness of each para-aramid fiber thread 18 may also be equal to the thickness of each silk thread 12. The resulting fabric 10 may thus comprise 50% silk and 50% para-aramid fiber. Each horizontal para-aramid fiber thread 20 may be positioned between adjacent horizontal silk threads 14 of the plurality of horizontal silk threads and each vertical para-aramid fiber thread 22 may be positioned between adjacent vertical silk threads 16 of the plurality of vertical silk threads.

Figure 4:
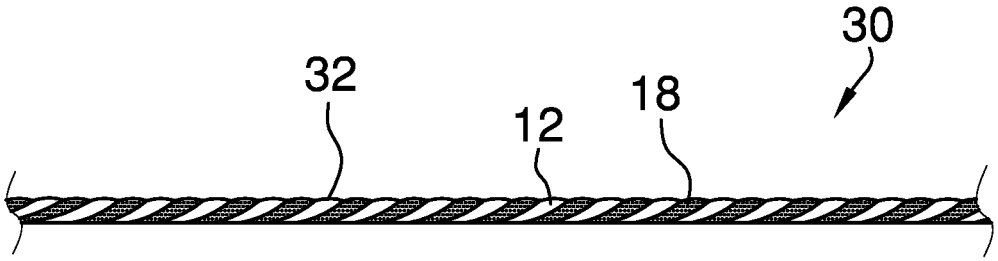
FIG. 4 is a detail view of an alternative embodiment of the disclosure.

An alternative embodiment of the invention 30 shown in FIG. 4 comprises a hybrid thread 32. The hybrid thread 32 comprises one silk thread 12 twisted with one para-aramid fiber thread 18. The resulting hybrid thread 32 can be woven to create the fabric 10.

The fabric 10 is bulletproof and substantially flexible to create articles of clothing such as, but not limited to, trousers, shirts 34, and the like.

In use, garments made from the fabric 10 are worn as a protective measure for security guards, law enforcement, military, and the like. These garments are more comfortable for the wearer than traditional bulletproof vests and equipment.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A silk blend ballistic fabric comprising:

a plurality of silk threads; and a plurality of para-aramid fiber threads interwoven with the plurality of silk threads, wherein the resulting fabric is bulletproof and substantially flexible, a thickness of each para-aramid fiber thread being equal to a thickness o each silk thread.

2. The silk blend ballistic fabric of claim 1 further comprising the plurality of silk threads and the plurality of para-aramid fiber threads being present in a 1:1 ratio.

3. The silk blend ballistic fabric of claim 1 further comprising the plurality of silk threads comprising a plurality of horizontal silk threads interwoven through a plurality of vertical silk threads; the plurality of para-aramid fiber threads comprising a plurality of horizontal para-aramid fiber threads interwoven through a plurality of vertical para-aramid fiber threads and the plurality of vertical silk threads, the plurality of vertical para-aramid fibers being interwoven through the plurality of horizontal silk threads.

4. The silk blend ballistic fabric of claim 3 further comprising each horizontal para-aramid fiber thread being positioned between adjacent horizontal silk threads of the plurality of horizontal silk threads and each vertical para-aramid fiber thread being positioned between adjacent vertical silk threads of the plurality of vertical silk threads.

5. A silk blend ballistic fabric comprising:

a plurality of silk threads, the plurality of silk threads comprising a plurality of horizontal silk threads interwoven through a plurality of vertical silk threads; and a plurality of para-aramid fiber threads, the plurality of para-aramid fiber threads comprising a plurality of horizontal para-aramid fiber threads interwoven through a plurality of vertical para-aramid fiber threads and the plurality of vertical silk threads, the plurality of vertical para-aramid fibers being interwoven through the plurality of horizontal silk threads, the plurality of silk threads and the plurality of para-aramid fiber threads being present in a 1:1 ratio and a thickness of each para-aramid fiber thread being equal to a thickness of each silk thread, each horizontal para-aramid fiber thread being positioned between adjacent horizontal silk threads of the plurality of horizontal silk threads and each vertical para-aramid fiber thread being positioned between adjacent vertical silk threads of the plurality of vertical silk threads, wherein the resulting fabric is bulletproof and substantially flexible.

6. A silk blend ballistic fabric comprising:

a hybrid thread comprising:

a silk thread; and a para-aramid fiber thread twisted with the silk thread, wherein the resulting hybrid thread can be woven to create a fabric that is bulletproof and substantially flexible, a thickness of each para-aramid fiber thread being equal to a thickness of each silk thread.

* * * * *